United States Patent [19]

Krüpper

[11] Patent Number: 4,613,537

[45] Date of Patent: Sep. 23, 1986

[54] GRIP TAPES BASED ON PLASTIC-COATED SUPPORTING MATERIALS

[75] Inventor: Günther Krüpper, Wartenberg, Fed. Rep. of Germany

[73] Assignee: Industrie-Entwicklungen Krüpper, Wartenberg, Fed. Rep. of Germany

[21] Appl. No.: 724,623

[22] Filed: Apr. 18, 1985

[30] Foreign Application Priority Data

Apr. 19, 1984 [DE] Fed. Rep. of Germany ..... 3414978

[51] Int. Cl.[4] ..... B32B 7/00

[52] U.S. Cl. ..... 428/192; 428/151; 428/193; 428/230; 428/254; 428/264; 428/272; 428/274; 428/290; 428/337; 428/904

[58] Field of Search ..... 428/151, 254, 264, 272, 428/274, 290, 904, 192, 193, 230, 337

[56] References Cited

U.S. PATENT DOCUMENTS 4,342,805 8/1982 McCartney ..... 428/290
4,496,624 1/1985 McCartney ..... 428/290

*Primary Examiner*—Marion C. McCamish
*Attorney, Agent, or Firm*—Frishauf, Holtz, Goodman & Woodward

[57] ABSTRACT

According to the invention, grip tapes based on plastic-coated supporting materials are described which have a supporting material comprising nonwoven, woven or knitted fabric having an extensibility before processing of at least 10% in the crosswise and/or lengthwise and/or diagonal direction, and an impregnation based on polyurethanes which is applied by means of wet coagulation. The grip tapes are obtained by soaking a supporting material of nonwoven, woven or knitted fabric and having an extensibility of at least 10% in the crosswise and/or lengthwise and/or diagonal direction in a solution of polyurethane-based impregnating agent, dissolved in a water-soluble solvent, passing the impregnated material through at least one coagulation bath comprising a mixture of the solvent with water, pressing the liquid out of the coagulate-coated supporting material, then rinsing the material with water and pressing it again and drying it, then cutting it as needed into strips. The grip tapes exhibit high extensibility, provide excellent gripping and non-slip qualities and high moisture absorption and shock absorbency, and are particularly well suited for sheathing the handles of sports equipment.

27 Claims, No Drawings

GRIP TAPES BASED ON PLASTIC-COATED SUPPORTING MATERIALS

Grip tapes serve to improve the manipulation of such items as sports equipment or vehicle steering wheels. They are used in particular for tennis, ping-pong and squash racquets and for golf clubs. The stock or handle of these implements is wrapped with grip tape in order to improve the grip of the implement. In the case of sports equipment and steering wheels, it is particularly essential to provide a good grip and prevent slipping.

BACKGROUND

Grip tapes of leather or textile material are already known. Grip tapes based on plastic-coated supporting materials are also in use for sports equipment such as clubs and racquets. An additional operation is usually necessary, to roughen the surface and render it suede-like in structure, so as to make these tapes non-slipping. Although grip tapes of this king do afford a certain protection against slipping, they still do not have an optimal grip.

THE INVENTION

It is an object to devise grip tapes based on plastic-coated supporting materials which by their adhesiveness or lack or slipperiness impart a good grip to the handle of the implement without substantially changing the handle thickness, and which at the same time are highly moisture absorbent and highly shock-absorbent.

Briefly, the grip tapes are based on a supporting fabric material of nonwoven, woven or knitted material which has an extensibility before processing of at least 10%, crosswise and diagonally or and/or lengthwise; the material is impregnated by wet coagulation on the basis of polyurethanes.

In a particularly favorable embodiment, the supporting material of the grip tapes comprises a spun nonwoven or felted material, in particular a needled spun nonwoven material, which before processing has an extensibility of at least 30%, lengthwise and/or diagonal and/or crosswise, and in particular a crosswise extensibility of at least 50%.

In a further preferred embodiment, the supporting material is of cotton gauze, which before being processed to make a grip tape has an extensibility in the crosswise diagonal or lengthwise direction of at least 20%.

The thickness of the nonwoven material used as a supporting material is preferably in the range from 0.2 to 1.0 mm, in particular from 0.3 to 0.35 mm, and the thickness of the woven material used as the supporting material is preferably in the range from 0.2 to 1.0 mm and in particular from 0.7 to 0.8 mm.

Nonwoven-based grip tapes preferably have a thickness in the range from 0.35 to 1.2 mm, in particular from 0.45 to 0.5 mm; woven-based grip tapes preferably have a thickness in the range from 0.3 to 1.2 mm and in particular from 0.8 to 0.9 mm.

The impregnation or coating on the basis of polyurethanes favorably contains, in addition to polyurethanes, up to 30% by weight of further thermoplastic polymers, in particular polyvinyl chloride.

The invention also relates to a method for fabricating grip tapes on the basis of plastic-coated supporting materials. In this method, a nonwoven, felted, woven or knitted supporting material having an extensibility of at least 10%, in the crosswise and/or diagonal and/or lengthwise direction is soaked with a solution of impregnating agent based on polyurethanes, dissolved in a water-soluble solvent; the impregnated material is passed through at least one coagulation bath comprising a mixture of the solvent with water; the liquid is compressed out of the coagulate-coated supporting material; the material is then rinsed with water, compressed again and dried; and the final material is then cut into strips as needed.

In fabricating the grip tapes, dimethyl formamide is preferably used as the solvent for the polyurethane-based impregnating agent.

In a specialized embodiment of the method for fabricating grip tapes, the supporting material impregnated with polyurethane solution is first passed through a first aqueous coagulation bath having a relatively higher proportion of solvent, such as 15 to 35% by weight, and then through a second aqueous coagulation bath with a lesser proportion of solvent, such as 5 to 20% by weight.

Before being impregnated with polyurethane solution, the supporting material is suitably subjected to a preliminary treatment with alkalizing agents or chlorinated hydrocarbons. Fine fibers or fibrils are thereby attained, because the fibers, for instance 1.7 dtex in thickness, are split several times--preferably six times. Because of the fineness of the fibers, there in an increased inclusion of air bubbles in the final product, and excellent absorbency is attained.

It is particularly favorable to cut the long edges of the grip tapes off at an angle.

DETAILED DESCRIPTION

The grip tapes according to the invention have as their supporting material a nonwoven, woven or knitted material, the extensibility of which before processing is at least 10% in the crosswise and/or lengthwise and/or diagonal direction. Preferably the extensibility of the supporting material in the crosswise and/or lengthwise and/or diagonal direction is each between 20 and 50%. Depending upon the intended use of the grip tape, it may amount to from 50 to 70% or even 100% or more. The extensibility of the supporting material is of particular significance for the outstanding properties of the grip tapes according to the invention.

If woven materials are used as the supporting material, they are primarily of cotton, natural/synthetic blends, or synthetic fabric. Gauze, and especially cotton gauze, proves to be particularly favorable. A cotton gauze similar to that used in treating wounds, but with a crosswise or lengthwise extensibility of at least 20% and in particular at least 50%, is preferred.

Knits can also be used successfully as supporting materials for the grip tapes according to the invention, as long as their lengthwise and/or crosswise and/or diagonal extensibility is at least 10%, and preferably 30% and more. Knitted fabrics based on yarns made of synthetic, natural or blended fibers are suitable.

If a nonwoven fabric is used as the supporting material, the most varied synthetic, natural and/or blended fibers are possible. Nonwovens based on polyester, polyacrylic and/or polyethylene fibers as well as blended fibers of synthetic and cotton prove to be favorable. Any arbitrary nonwovens may be used on the condition that they have the appropriate extensibility of at least 10% in the crosswise and/or lengthwise and/or diagonal direction. Spun nonwoven materials and in particular needled spun nonwoven materials are advantageously used as supporting material. The nonwovens have very fine fibers as a rule and preferably contain fibers in the denier range of 1.7 dtex. There is no particular restriction on the fiber length but it is generally between 20 and 70 mm and preferably between 30 and 50 mm.

The thickness of the supporting material can be kept very slight; this has the advantage that the finished tapes are similarly thin, so that the thickness of the handle is increased only negligibly when the grip tape is applied. Because of the high extensibility of the grip tapes, the increase in handle thickness when the tape is wound onto the handle can be kept extraordinarily small. With increasing extensibility on the part of the tape, the change in handle thickness becomes increasingly small.

The supporting material comprising a nonwoven, woven or knitted fabric with a crosswise and/or lengthwise and/or diagonal extensibility of at least 10% is coated with a polyurethane-based impregnation. Polyurethanes which may be used include the known polyurethane elastomers, which may be modified as needed by working in softening or plasticizing additives. The polyurethanes may further contain additional thermoplastic polymers such as polyvinyl acetate, polyacrylates or preferably polyvinyl halides, in particular polyvinyl chloride, in quantities of up to 30% by weight. The term "polyurethane" as used here is accordingly intended to include any polyurethanes, possibly modified, and possibly including small quantities of further thermoplastic polymers.

In fabricating the grip tapes according to the invention, the supporting material is impregnated with a solution based on polyurethanes, dissolved in a water-soluble solvent. The web of supporting material is suitably passed through a bath of polyurethane solvent. Many water-soluble solvents are suitable as a solvent for the polyurethane that is to be applied; examples are ketones such as acetone or esters such as ethyl acetate as well as cimethyl acetamide or dimethyl sulfoxide. Preferably, however, dimethyl formamide is used as the solvent for polyurethane. Mixtures of such solvents may also be used. The use of water-soluble solvents, and especially dimethyl formamide, has a decisive influence on the incorporation of millions of air bubbles into the tape and thus increases its absorbency for sweat on the hands and also results in excellent shock absorption. The web of supporting material may, if needed, be passed several times through the polyurethane solvent bath. Multiple immersion of the supporting material in the polyurethane solution, for instance twice or three times, with a dwell time of approximately 2 to 10 seconds per bath increases the penetration of the supporting material, so that it becomes thoroughly impregnated.

The polyurethane impregnation bath may contain conventional chemical additives, such as plasticizers, dyes, color pastes, slip agents, stabilizers and so forth. The addition of polyglycols serves particularly to plasticize the composition and increases the incorporation of air bubbles.

The supporting material may, if needed, also be subjected to a preliminary treatment, before being impregnated with the polyurethane solution, in order to split the fibers of the supporting material. Examples of suitable pretreatments are either an alkalizing treatment with conventional alkalizing agents, such as sodium carbonate, suitably used in a 5% to 10% aqueous solution, or impregnation with chlorinated hydrocarbons, such as methylene chloride. The alkalizing treatment is favorably performed at elevated temperatures, preferably at approximately 60° to 90° C. and in particular 80° to 90° C. Pretreatment with chlorinated hydrocarbons is suitably performed at their boiling point and within only a very short period, for instance 1 minute. Both these pretreatments cause multiple splitting of the fibers; frequently, the fibers are split six or more times. Pretreatment of the supporting material is not absolutely necessary; however, it does increase the incorporation of air bubbles when the polyurethane is applied and while it coagulates.

After the impregnation of the supporting material with the polyurethane solution, the impregnated material can be passed immediately through at least one coagulation bath of a mixture of the water-soluble solvent used to dissolve the polyurethane, and water. It is not necessary to press out or dry the supporting material that has been impregnated with polyurethane solution. However, it is suitable for the supporting material, having been impregnated once or twice, to be squeegeed to the desired thickness while the underside of the material passes over a steel roller, so that the top and bottom surfaces of the grip tape material are equally smooth. The tape thus has the advantage that it can be used on both sides. Two coagulation baths are preferably used, the first bath still containing a considerable proportion of solvent, for example from 15 to 35% by weight and in particular from 20 to 30% by weight, while only a small proportion of solvent, approximately 5 to 20% by weight and preferably approximately 10% by weight, is contained in the second bath. The aqueous coaguation bath is suitably kept at a slightly elevated temperature, for instance approximately 20° to 30° C. If a plurality of coagulation baths are used, then the temperature of the first aqueous bath is usually somewhat higher, such as 25° to 30° C., while the second aqueous bath has temperatures of approximately 20° to 25° C. Naturally the number of coagulation baths may be increased, so long as the water content of the coagulation bath always increases in proportion to the solvent content from the first to the last bath. By using two or more coagulation baths, not only is the polyurethane coagulated, but an extensive rinsing out of the water-soluble solvent is attained, while at the same time a large quantity of air bubbles forms within the structure.

After the material leaves the coagulation bath, the liquid is compressed out of the supporting material. This is suitably effected by passing the material through rollers.

Following the compression operation, the coated material is rinsed with water, pressed once again, and dried. Washing is performed as a rule with normal cold water, perhaps with the addition of softeners. The web of material is suitably passed over a drum and made taut, and at certain intervals water is worked into the material and pressed out of it once again. After the last pressing, the material is dried. The pressed, coated web material is preferably passed through a drying oven kept at temperatures of from 100° to 160° C. and in particular from 120° to 150° C, in order to remove the remaining liquid. The coagulate-coated supporting material undergoes shrinkage during the fabrication process, that is, during impregnation, coagulation and rinsing, which is usually in the range from 10 to 15% and may amount to as much as 30%, so that generally the web material is tautened again during the drying operation. As a result of the tautening, the width expands by approximately 15 to 25%, preferably 20%.

The coated material obtained after the drying operation may then be calendar-coated; in so doing, oiled paper is suitably rolled in between, to prevent layers of webs from sticking to one another.

Depending on the intended use, the coated web material thus obtained are then cut into tapes or strips of the desired size, for instance 20 to 30 mm in width, and can then be prepared for delivery to the consumer, for instance being wound onto a hard paper core and blister-packed. Depending on the desired extensibility of the tape, the coated web material can be cut crosswise, diagonally or lengthwise. Especially, the coated web material is cut crosswise, so that the high extensiblity of the initial supporting material in the crosswise direction now corresponds to the extensiblity of the grip tape in the longitudinal direction. According to a preferred embodiment, coated fabric material is cut at an angle to the warp or weft direction of the fabric resulting in very extendable diagonal tapes which on application to grips or grip rests adapt very well to bends, roundings or curves without formation of folds.

The cutting operation is suitably effected with the aid of punching tools, especially in the presence of anti-sticking agents such as talcum.

It is particularly desirable for the grip tapes according to the invention, especially those intended for being wound in a helical pattern about equipment handles, to be cut at an angle on the long edges. This cutting or beveling may be done on both long edges of one surface, or on two long edges of opposite surfaces, so that the oblique cut surfaces extend either at an angle to one another or parallel to one another. The coated material according to the invention proves to be completely cleanly cut at the cut edges without any fraying of the supporting material. The angled cutting operation can be performed without using any of the edge adhesives that are otherwise conventional. The angled cutting of the long edges of the grip tape enables an overlapping, helical winding of the tape onto the handle without affecting the thickness of the handle or creating ridges in the areas of overlap.

The grip tapes according to the invention may be used for the most varied purposes. They serve to sheath implement handles which must lie particularly securely in the hand, and because of their specialized embodiment they provide a gripping, slip-free, vibration-damping surface that is particularly easy to handle. The grip tapes are particularly well suited for sports equipment handles, such as those of tennis, ping-pong and squash racquets, hockey sticks and golf clubs, for the booms on windsurfing boards, and for bicycle handlebars and steering wheels. A further application of the grip tapes is in target shooting, for covering the surfaces of the hand guard and the recessed grip of weapons. In this case, a suitably sized piece of grip tape, provided with selfadhesive press-and-stick glue and protective paper on its underside, is applied to the gripping surfaces after removing the protective foil, so that the weapon can be held accurately without any slipping of the hand. Similarly, the stocks of golf clubs are sheathed by applying a trapezoidal piece of grip tape onto the stock. In the case of racquets, such as those for tennis, squash or ping-pong, the grip tape is wound helically onto the handle.

Racquets such as tennis or squash racquets generally have a first or base grip tape, which corresponds to the leather band formerly used and which is frequently already applied when the racquet is manufactured. Usually relatively great thicknesses are preferred for this base grip tape. The thinner grip tapes, contrarily, are particularly well suited for use as overgrip tapes, which are wound onto the handle over the base grip tape. Depending on how intensely the athlete plays, the overgrip tape, especially one based on nonwoven fabric, which is distinguished by its extreme thinness, is wound on or replaced at variable time intervals. The above-mentioned specialized embodiment of the tapes with bevelled or angle-cut edges makes it possible to apply the grip tape smoothly, without forming ridges in the areas of overlap. The extreme thinness of these tapes, combined with an extremely high extensibility, enables grip tapes to be applied to handles without perceptibly increasing the thickness of these handles; especially in the case of racquets used for hitting balls, this proves to be highly advantageous and it improves the playing characteristics considerably. The increased adhesion and absolute lack of slipperiness provided by the grip tapes according to the invention are also characteristics which are particularly highly esteemed in racquets. The products have an extremely soft surfaces, without requiring further operations such as abrading or multiple calendering. A factor that proves to have considerable significance for the quality of the grip tapes according to the invention is the millions of air bubbles that are incorporated into the material, so that a slight, sponge-like resiliency is attained, thereby inhibiting recoiling as the handle is manipulated during play. The smooth and shock-absorbent embodiment of the grip tapes completely prevents the formation of blisters on the hands when using handles wound with grip tapes of this kind, and this can help prevent the unpleasant condition known as tennis elbow. The high absorbency imparted by the incorporated air bubbles assures that perspiration, which when using sports equipment such as racquets often proves to be very disadvantageous and is deleterious to playing characteristics, is quickly removed. The grip tapes according to the invention, because of the combination of components named herein and because of the specialized manner of their fabrication, are distinguished by a longer useful life and by a favorable heat resistance up to approximately 80° C., and for brief periods up to even higher temperatures.

The following examples explain the invention. The percentages given are all by weight.

EXAMPLE 1

A supporting web of needled polyester spun nonwoven or felted fabric having a thickness of 0.3 mm, a fiber length from 30 to 50 mm, and an extensibility in the crosswise direction of 70% and in the lengthwise direction of 10% is passed, in order to be pretreated, through an alkalizing bath of 6% $Na_2CO_3$ solution in water that has been heated to approximately 80° C., in order to attain a splitting of the fibers. After being in contact with the alkalizing bath for approximately 10 minutes, the pretreated supporting web is passed into a polyurethane impregnation bath, comprising an 8 to 10% solution of polyurethane in dimethyl formamide with the addition of from 0.3 to 0.9% softeners or plasticizers and 3% color paste. The dwell time of the supporting web in the polyurethane impregnation bath is approximately 10 seconds. The coated supporting web is then passed via rollers, without being compressed or dried, into the coagulation bath. The first coagulation bath comprises water with a 30% dimethyl formamide content and is kept at a temperature of approximately 30° C. After passing through the first coagulation bath, the coated web passes into a second aqueous coagulation bath, which now contains only 10% dimethyl formamide. The temperature of the second coagulation bath is between 20° and 24° C. After leaving the coagulation baths, the polyurethane has coagulated on the nonwoven material and the solvent has been for the most part removed. Following the coagulation step, the liquid contained in and on the web is pressed out by rollers, and the treated web is subsequently rinsed out with cold water, then passed over a drum and made taut. Water is once again pressed into the material and then pressed out again. The process is repeated twice. Subsequently, the solvent is washed out of the coated material completely. The coated nonwoven web undergoes a shrinkage of up to 15% during the above processes. During the ensuing drying in a drying oven at approximately 150° C., the web is tautened and expanded in width by approximately 20%. After the drying operation, the web material is calendar-coated with oiled paper being laid between layers of webs in order to prevent them from sticking together. The finished webs are cut crosswise into strips 25 mm (1 inch) in width and rolled on hard paper cores. The thickness of the finished strips is 0.45 mm.

The grip tapes thus obtained are wound onto the handles of tennis racquets and ping-pong paddles. The implement handles wound in this manner were changed hardly at all in terms of handle thickness, because of the slight thickness and extraordinary extensibility of the web material. The racquet and paddle handles lay securely in the hand, had a good grip and proved to have excellent playing characteristics because of their shock-absorbent and moisture-absorbent properties.

EXAMPLE 2

The steps according to Example 1 were repeated, with the exception that, as the supporting material, a woven cotton fabric having a crosswise extensibility of 60% and a thickness of 0.7 mm was used.

The grip tapes thereby obtained have a thickness of from 0.9 to 1.0 mm and are used as base tapes for tennis racquet handles or as sheaths for golf club handles. The tapes intended for winding around tennis racquet handles are cut into stips approximately 25 mm in width and are cut at an angle on the long edges of one surface. By cutting off the long edges at an angle, the tapes can be wound helically around the racquet handles without forming any ridges at all in the areas of overlap.

The tapes intended for sheathing golf club handles are coated with press-and-stick glue and protective foil and then cut into trapezoid shapes adapted to the thickness of the golf club handle, and glued onto the handle.

The handles sheathed with the tapes have excellent absorbency and resiliency and are highly slip-free.

EXAMPLE 3

A handle tape is fabricated in accordance with Example 2.

The tapes thus obtained were coated on one side with press-and-stick glue and provided with a protective foil Pieces of tape of appropriate size were, after the protective foil was removed, glued onto the gripping location of the hand guard and in the recessed grip of weapons, and because of the excellent absorbency and shock absorption and lack of slipperiness they enabled accurate manipulation and thus increased accuracy in hitting the target.

EXAMPLE 4

A spun nonwoven fabric of blended polyacrylic and cotton fibers with a fiber length of 40 mm, a crosswise extensibility of up to 40% and a lengthwise extensibility of 20% and a thickness of 0.35 mm was passed, without preliminary treatment, twice through a polyurethane impregnation bath, the dwell time per bath being approximately 5 seconds. The bath contained a solution of polyurethane in dimethyl formamide with the addition of slip agents and dyestuff. After the impregnation with polyurethane solution, coagulation was effected in a water bath containing 20% dimethyl formamide and at a temperature of 25° C.

After the liquid is pressed out, the web material is washed and dried in the manner described for Example 1 and cut into tapes which are wound over the base grip tape of tennis racquets.

The grip tapes thus obtained exhibited excellent gripping and non-slip characteristics and excellent absorbency and shock absorption.

I claim:

1. Grip tape for humanely handled equipment to provide a non-slip, shock absorbant and moisture accepting surface comprising a supporting fabric which, before treatment or processing, has, in at least one direction, a stretchability or extendability of from 20% to 50%, and an impregnant comprising a base of a polyurethane present in at least 70%, by weight of the impregnant, impregnating the supporting fabric, said impregnant being applied by wet coagulation from an anaqueous solution.

2. A grip tape according to claim 1 including tiny air bubbles retained in said impregnant and supporting fabric to provide for shock absorbancy.

3. Grip tape according to claim 1, wherein the supporting fabric comprises a spun nonwoven or felted fabric which, before treatment or processing, has a stretchability or extendability in at least one of: transverse direction crosswise direction; longitudinal direction of at least 30%.

4. Grip tape according to claim 3, wherein the stretchability or extendability in transverse or crosswise direction is at least 50%.

5. Grip tape according to claim 1, wherein the supporting fabric comprises cotton gauze which, before treatment or processing, has said stretchability or extendability in at least one; transverse direction; crosswise direction; longitudinal direction.

6. Grip tape according to claim 1, wherein the supporting fabric comprises a nonwoven or felted material having a thickness of from between 0.2 to 1 mm.

7. Grip tape according to claim 6, wherein said thickness is between 0.3 to 0.35 mm.

8. Grip tape according to claim 1, wherein said supporting fabric comprises a woven material having a thickess of between 0.2 to 1 mm.

9. Grip tape according to claim 8, wherein said thickness is between about 0.7 to 0.8 mm.

10. Grip tape according to claim 1, wherein said supporting fabric comprises a base fabric of felted or nonwoven material, and said grip tape has a thickness of between about 0.35 to 1.2 mm, especially between 0.45 and 0.5 mm.

11. Grip tape according to claim 1, wherein said supporting fabric comprises a woven fabric;

and wherein said grip tape has a thickness of from between 0.3 to 1.2 mm, especially 0.8 to 0.9 mm.

12. Grip tape according to claim 1, wherein said impregnant comprises said base of polyurethanes and additional thermoplastic polymers in up to about 30% by weight.

13. Grip tape according to claim 12, wherein said additional thermoplastic polymers comprise polyvinylchloride.

14. Grip tape according to claim 1, wherein the longitudinal edges of the tape are inclined or chamfered.

15. Grip tape according to claim 1, wherein said direction of extendability or stretchability extends in longitudinal direction of the tape.

16. Grip tape according to claim 1, wherein said direction of stretchability or extendability extends in transverse direction or crosswise direction of the tape.

17. Grip tape according to claim 1, wherein said direction of stretchability or extendability extends diagonally with respect to the tape.

18. Grip tape according to claim 1, wherein said direction of stretchability or extendability extends in at least two of the directions: longitudinally of the tape; crosswise or transversely of the tape; diagonally of the tape.

19. Method of making a grip tape for humanely handled equipment to provide a non-slip, shock absorbant and moisture accepting surface comprising providing a supporting fabric which, before treatment or processing has, in at least one direction, a stretchability or extendability of from 20% to 50%, said supporting fabric comprising at least one of: a nonwoven or felted or woven or knitted fabric;

impregnating said supporting fabric with an impregnant solution based on polyurethanes present in at least up to 70% by weight, in a water soluble solvent by soaking said supporting fabric in said impregnant;

conducting the so soaked and impregnated material through at least one coagulating bath including a mixture of solvent and water;

pressing-off the liquid from the supporting fabric, coated with the coagulate;

rinsing the material with water; and removing the water by pressing and drying while retaining tiny air bubbles within the coated fabric.

20. Method according to claim 19, further including the step of chamfering or cutting at an inclination the longitudinal edges of the tape.

21. Method according to claim 19, further including the step of cutting the impregnated rinsed and dried fabric at an angle with respect to the warp or weft direction of fibers forming the supporting fabric.

22. Method according to claim 19, wherein said solvent for the impregnant based on polyurethanes comprises dimethylformamide.

23. Method according to claim 19, wherein said step of carrying the soaked and impregnated supporting fabric through a coagulating bath comprises conducting the supporting fabric through a first aqueous coagulating bath and then through a second aqueous coagulating bath, in which said first aqueous coagulating bath has a higher proportion of solvent than said second aqueous coagulating bath.

24. Method according to claim 19, including the step of pretreating the supporting fabric in advance of soaking the supporting fabric with the urethane based impregnant by subjecting said supporting fabric to treatment or processing with at least one of: an alkalizing agent; a chlorinated hydrocarbon.

25. Method according to claim 19 wherein said impregnant comprises said base of polyurethanes and additional thermoplastic polymers in up to about 30% by weight.

26. A grip tape for humanely handled equipment to provide a non-slip, shock absorbant and moisture accepting surface comprising a supporting fabric made of at least one of the materials of the group consisting of: nonwoven, felted, woven, knitted supporting material, said fabric, before treatment or processing having, at least in one direction, including: longitudinally of the tape; transversely or crosswise of the tape; diagonally of the tape, a stretchability or extendability of from 20% to 50%;

said grip tape including an impregnant consisting of a base of at least 70%, by weight of a polyurethane based material, said impregnant impregnating the fabric, and retaining therein tiny air bubbles, said impregnant being applied by the method as claimed in claim 19.

27. A grip tape according to claim 26, wherein said impregnant comprises said base of polyurethanes and additional thermoplastic polymers in up to about 30% by weight.

* * * * *